US009758344B2

(12) United States Patent
Fauconnet et al.

(10) Patent No.: US 9,758,344 B2
(45) Date of Patent: Sep. 12, 2017

(54) ELEVATOR TRAVELLING CABLE PROTECTION

(75) Inventors: Aurelien Fauconnet, Isdes (FR); Valerie Mauguen, Sully sur Loire (FR); Etienne Delachatre, Saint Benoit (FR)

(73) Assignee: OTIS ELEVATOR COMPANY, Farmington, CT (US)

( * ) Notice: Subject to any disclaimer, the term of this patent is extended or adjusted under 35 U.S.C. 154(b) by 392 days.

(21) Appl. No.: 14/371,185

(22) PCT Filed: Jan. 10, 2012

(86) PCT No.: PCT/IB2012/000129

§ 371 (c)(1),
(2), (4) Date: Jul. 9, 2014

(87) PCT Pub. No.: WO2013/104942

PCT Pub. Date: Jul. 18, 2013

(65) Prior Publication Data

US 2014/0353091 A1 Dec. 4, 2014

(51) Int. Cl.
*B66B 7/06* (2006.01)

(52) U.S. Cl.
CPC ..... *B66B 7/06* (2013.01); *B66B 7/064* (2013.01)

(58) Field of Classification Search
CPC ..... B66B 7/06; B66B 7/064
USPC ..... 187/413
See application file for complete search history.

(56) References Cited

U.S. PATENT DOCUMENTS

| | | | | |
|---|---|---|---|---|
| 1,810,960 A | | 6/1931 | Hall | |
| 1,864,093 A | | 6/1932 | Prince | |
| 2,017,372 A | * | 10/1935 | Morrison | B66B 7/06 187/413 |
| 3,430,733 A | * | 3/1969 | Smith | B66B 7/064 138/128 |
| 3,519,101 A | * | 7/1970 | Sieffert | B66B 9/187 187/256 |
| 3,882,968 A | * | 5/1975 | Suozzo | B66B 7/068 187/264 |

(Continued)

FOREIGN PATENT DOCUMENTS

| | | |
|---|---|---|
| JP | S55140059 U | 10/1980 |
| JP | 2005350214 A | 12/2005 |

OTHER PUBLICATIONS

PCT International Search Report for International application No. PCT/IB2012/000129 dated Sep. 25, 2012.

(Continued)

*Primary Examiner* — Michael Riegelman
(74) *Attorney, Agent, or Firm* — Carlson, Gaskey & Olds

(57) ABSTRACT

An exemplary device for protecting an elevator travelling cable connected to an elevator car comprises a deflector that is configured to be secured to one of an elevator car or the travelling cable. The deflector allows the travelling cable to extend below an associated elevator car a first distance from a bottom of the elevator car when the elevator car is at least a selected height above a bottom of a hoistway. The first distance is at least equal to a natural dynamic bending radius of the travelling cable. The deflector facilitates the travelling cable extending below the bottom of the elevator car a second distance that is less than the natural dynamic bending radius when the elevator car is below the selected height.

8 Claims, 8 Drawing Sheets

(56) References Cited

U.S. PATENT DOCUMENTS

| | | | | |
|---|---|---|---|---|
| 3,885,773 | A * | 5/1975 | Dunkelberger | B66F 9/205 187/413 |
| 4,058,186 | A * | 11/1977 | Mullis | B66B 7/06 174/70 R |
| 4,529,062 | A | 7/1985 | Lamprey | |
| 5,080,199 | A * | 1/1992 | McCallum, III | B66B 7/08 187/413 |
| 5,086,880 | A | 2/1992 | Pearce | |
| 6,786,306 | B2 * | 9/2004 | Tiner | B66B 7/064 187/266 |
| 7,147,087 | B2 * | 12/2006 | Tanaka | E04F 17/005 187/277 |
| 2006/0163010 | A1 * | 7/2006 | Ogava | B66B 7/068 187/401 |
| 2010/0243382 | A1 * | 9/2010 | Sterner | B65H 75/362 187/413 |
| 2013/0020150 | A1 * | 1/2013 | Ropponen | B66B 7/06 187/414 |
| 2014/0224590 | A1 * | 8/2014 | Puranen | B66B 5/022 187/247 |
| 2016/0083223 | A1 * | 3/2016 | Altenburger | B66B 7/068 187/251 |
| 2016/0159612 | A1 * | 6/2016 | Watanabe | B66B 7/064 187/413 |
| 2016/0207738 | A1 * | 7/2016 | Altenburger | B66B 7/064 |

OTHER PUBLICATIONS

Extended European Search Report for Application No. EP 12 86 5494 dated Oct. 7, 2016.

* cited by examiner

ELEVATOR TRAVELLING CABLE PROTECTION

BACKGROUND

Elevator systems include an elevator car that is movable within a hoistway for carrying passengers among different levels within a building, for example. A travelling cable provides power to components on the elevator car and facilitates communicating signals between devices on the elevator car and a controller that remains fixed near a top of the hoistway, for example. Travelling cables typically have one end secured in a fixed position relative to the hoistway, which is often near the top of the hoistway. An opposite end of the travelling cable is secured to a portion of the elevator car.

The length of a travelling cable is typically dictated by the distance that the elevator car travels between a lowest landing and a highest landing. A portion of the travelling cable typically extends below the elevator car. This portion typically has a natural dynamic bending radius that depends on the construction of the travelling cable. If the natural dynamic bending radius cannot be accommodated in a hoistway the travelling cable may experience unwanted sway. For example, travelling cables with a bend having a radius other than the natural radius can exhibit swaying.

Recent trends in elevator systems have included reducing the amount of space occupied by an elevator system. Eliminating machine rooms near the top of the hoistway and reducing the width of a hoistway are examples of space-savings approaches in the industry. Some elevator systems include a reduced pit depth at the bottom of the hoistway. Reducing the size of the pit provides the advantage of reducing the amount of space required by the elevator system. A reduced pit depth, however, introduces a challenge for accommodating the travelling cable. If the depth of the pit is insufficient to accommodate the natural dynamic bending radius of the travelling cable, the portion extending below the elevator car may contact the floor of the pit or other system components within the pit. Such contact is undesirable.

SUMMARY

An exemplary device for protecting an elevator travelling cable connected to an elevator car comprises a deflector that is configured to be secured to at least one of an elevator car or the travelling cable. The deflector allows the travelling cable to extend below an associated elevator car a first distance from a bottom of the elevator car that is at least equal to a natural dynamic bending radius of the travelling cable when the elevator car is at least a selected height above a bottom of a hoistway. The deflector facilitates the portion of the travelling cable extending below the elevator car a second distance that is less than the natural dynamic bending radius when the elevator car is below the selected height.

In one example device having one or more features of the device of the previous paragraph the deflector comprises a bracket that is configured to be secured to an elevator car.

In an example device having one or more features of the device of either of the previous paragraphs the bracket additionally or alternatively includes a first, horizontally oriented portion, a second, vertically oriented portion and a rounded section between the first and second portions.

In an example device having one or more features of the device of any of the three previous paragraphs the second, vertically oriented portion has a contact surface configured to contact the travelling cable and at least one guide surface adjacent the contact surface. The guide surface is oriented to guide the travelling cable into contact with the contact surface.

In an example device having one or more features of the device of any of the four previous paragraphs the device additionally or alternatively includes two guide surfaces. One of the guide surfaces is on a first side of the contact surface and another of the guide surfaces is on an opposite side of the contact surface.

In another example device having one or more features of the device of any of the previous paragraphs the deflector additionally or alternatively comprises a sling having a first end configured to be secured to the travelling cable and a second end configured to be secured to a stationary surface of the hoistway.

In an example device having one or more features of the device of the previous paragraph the deflector additionally or alternatively includes a resilient member near the second end of the sling for resiliently supporting the sling relative to the stationary surface.

In an example device having one or more features of the device of any of the two previous paragraphs the deflector additionally or alternatively comprises a spring.

In an example device having one or more features of the device of a previous paragraph, the deflector comprises a catch member secured to the travelling cable and a lift member that cooperates with the catch member to facilitate the travelling cable extending below the bottom of the elevator car at the second distance. In an example device having one or more features of the device of the previous paragraph, the deflector comprises a mover associated with the lift member and wherein the mover is configured to cause movement of the lift member responsive to the elevator car moving below the selected height.

In an example device having one or more features of the device of any of the previous two paragraphs, the lift member and the mover are coupled together so that the downward movement of the mover causes upward movement of the lift member.

In an example device having one or more features of the device of any of the previous three paragraphs, the deflector comprises an actuator configured to be supported on an elevator car such that the actuator causes downward movement of the mover as the elevator car moves below the selected height.

An exemplary elevator system includes an elevator car supported for movement within a hoistway. A travelling cable has one end supported in a fixed position relative to the hoistway and another end coupled to the elevator car. A deflector is configured to be secured to at least one of the elevator car or the travelling cable. The deflector allows the travelling cable to extend below the elevator car a first distance from a bottom of the elevator car that is at least equal to a natural dynamic bending radius of the travelling cable when the elevator car is at least a selected height above a bottom of the hoistway. The deflector facilitates the portion of the travelling cable extending below the elevator car a second distance from the bottom of the elevator car that is less than the natural dynamic bending radius when the elevator car is below the selected height.

In one example elevator system having one or more features of the system of the previous paragraph the deflector comprises a bracket secured to the elevator car.

In an example elevator system having one or more features of the system of either of the previous paragraphs the bracket additionally or alternatively includes a first, horizontally oriented portion, a second, vertically oriented portion and a rounded section between the first and second portions.

In an example elevator system having one or more features of the system of any of the three previous paragraphs the second, vertically oriented portion has a contact surface configured to contact the travelling cable and at least one guide surface adjacent the contact surface. The guide surface is oriented to guide the travelling cable into contact with the contact surface.

In an example elevator system having one or more features of the system of any of the four previous paragraphs the system additionally or alternatively includes two guide surfaces. One of the guide surfaces is on a first side of the contact surface and another of the guide surfaces is on an opposite side of the contact surface.

In another example elevator system having one or more features of the system of any of the previous paragraphs the deflector additionally or alternatively comprises a sling having a first end secured to the travelling cable and a second end configured to be secured to a stationary surface of the hoistway.

In an example elevator system having one or more features of the system of the previous paragraph the deflector additionally or alternatively includes a resilient member near the second end of the sling for resiliently supporting the sling relative to the stationary surface.

In an example elevator system having one or more features of the system of any of the two previous paragraphs the deflector additionally or alternatively comprises a spring.

In an example elevator system having one or more features of the system of any of the previous paragraphs, the deflector comprises a catch member secured to the travelling cable and a lift member that cooperates with the catch member to facilitate the travelling cable extending below the bottom of the elevator car at the second distance.

In an example elevator system having one or more features of the system of any of the previous paragraphs, the deflector comprises a mover associated with the lift member and wherein the mover is configured to cause movement of the lift member responsive to the elevator car moving below the selected height.

In an example elevator system having one or more features of the system of any of the previous paragraphs, the lift member and the mover are coupled together so that downward movement of the mover causes upward movement of the lift member.

In an example elevator system having one or more features of the system of any of the previous paragraphs, the deflector comprises an actuator configured to be supported on an elevator car such that the actuator causes downward movement of the mover as the elevator car moves below the selected height.

An exemplary method of protecting an elevator travelling cable that has one end secured to an elevator car and a second end secured in a fixed position relative to a hoistway includes providing a deflector on one of the elevator car or the travelling cable. A portion of the travelling cable extends below the elevator car a first distance from a bottom of the elevator car that is at least equal to a natural dynamic bending radius of the travelling cable when the elevator car is at least a selected height above a bottom of a hoistway. Deflecting the portion of the travelling cable with the deflector when the elevator car is below the selected height causes the travelling cable to extend below the elevator car a second distance that is less than the natural dynamic bending radius.

The various features and advantages of a disclosed example embodiment will become apparent to those skilled in the art from the following detailed description. The drawings that accompany the detailed description can be briefly described as follows.

DETAILED DESCRIPTION

Figure 1:
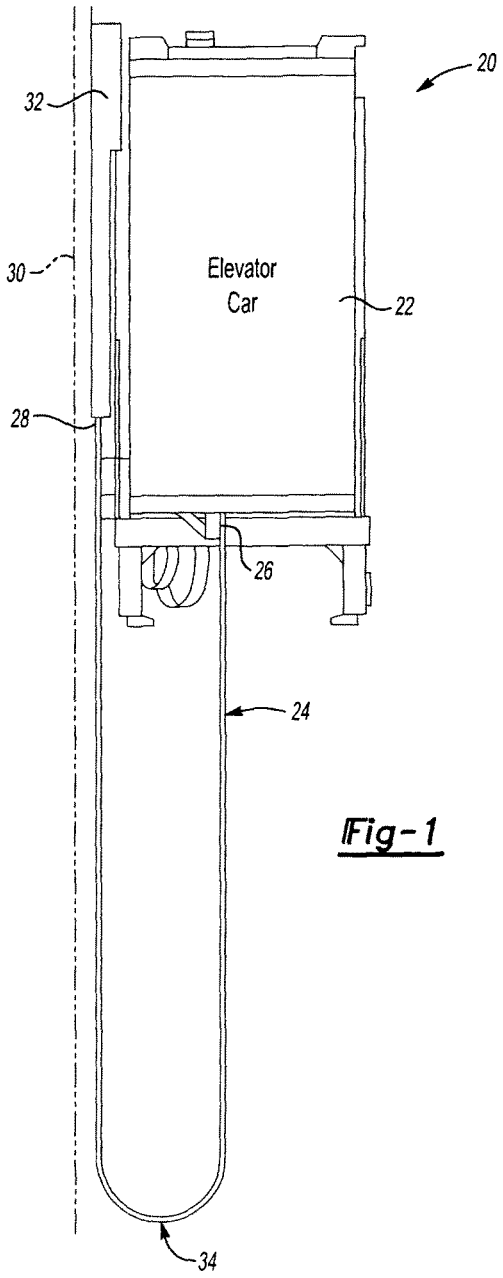
FIG. 1 schematically illustrates selected portions of an exemplary elevator system.

FIG. 1 schematically shows selected portions of an exemplary elevator system 20. Only selected portions are illustrated. Those skilled in the art will realize that many other components (e.g., rails, buffers, governors, machines, brakes, drives, controllers, traction members, etc.) may be included in an elevator system and that other elevator systems (e.g., different roping arrangements, etc.) could utilize the disclosed example embodiments. Such components are omitted from the illustration and this discussion for the sake of brevity and because those skilled in the art are already aware of such components.

The exemplary elevator system 20 includes an elevator car 22. A travelling cable 24 is associated with the elevator car 22. A first end 26 of the travelling cable 24 is secured to the elevator car 22, while a second end 28 is secured in a fixed position relative to a wall 30 of the hoistway. The second end 28 of the travelling cable 24 is positioned to make a connection with appropriate portions of a controller 32, which in the illustrated example is supported on the hoistway wall 30.

The travelling cable 24 is useful to carry electrical power to components associated with the elevator car 22, to carry control signal communications between the controller 32 and components associated with the elevator car 22 or to carry both depending on the needs of a particular installation. The travelling cable 24 has a known configuration and composition in this example.

In most elevator systems, the depth of the pit at the bottom of the hoistway is sufficient to accommodate the portion 34 of the travelling cable 24 that remains beneath the elevator car 22 when the car 22 is at a lowest position within the hoistway. The portion 34 has a natural bending radius based upon the composition of the travelling cable 24, for example. The natural dynamic bending radius is indicated by the cable manufacturer. For example, a typical travelling cable has a 300 mm natural dynamic bending radius.

There has been a recent trend to reduce the space occupied by elevator systems, which includes a desire to reduce the size of the elevator pit. Conventional elevator pits had a depth on the order of 1 meter to 1.5 meters, or greater. In some examples, reducing the space occupied by the elevator system includes reducing the depth of the pit. For example, a shallow pit having a depth of only approximately 0.3 meters or less may be desired. That depth cannot accommodate the natural bending radius of most elevator travelling cables.

Figure 2:
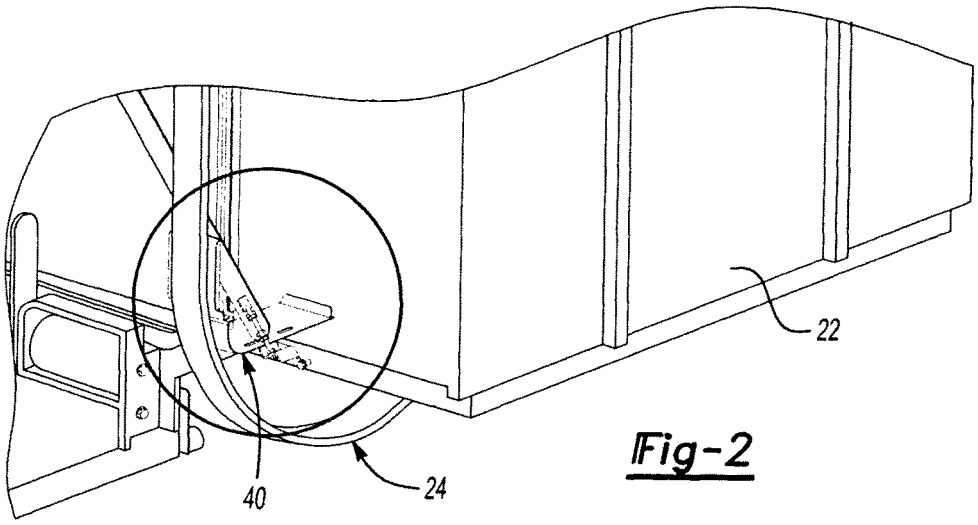
FIG. 2 illustrates an exemplary embodiment of a device for protecting an elevator travelling cable.
Figure 3:
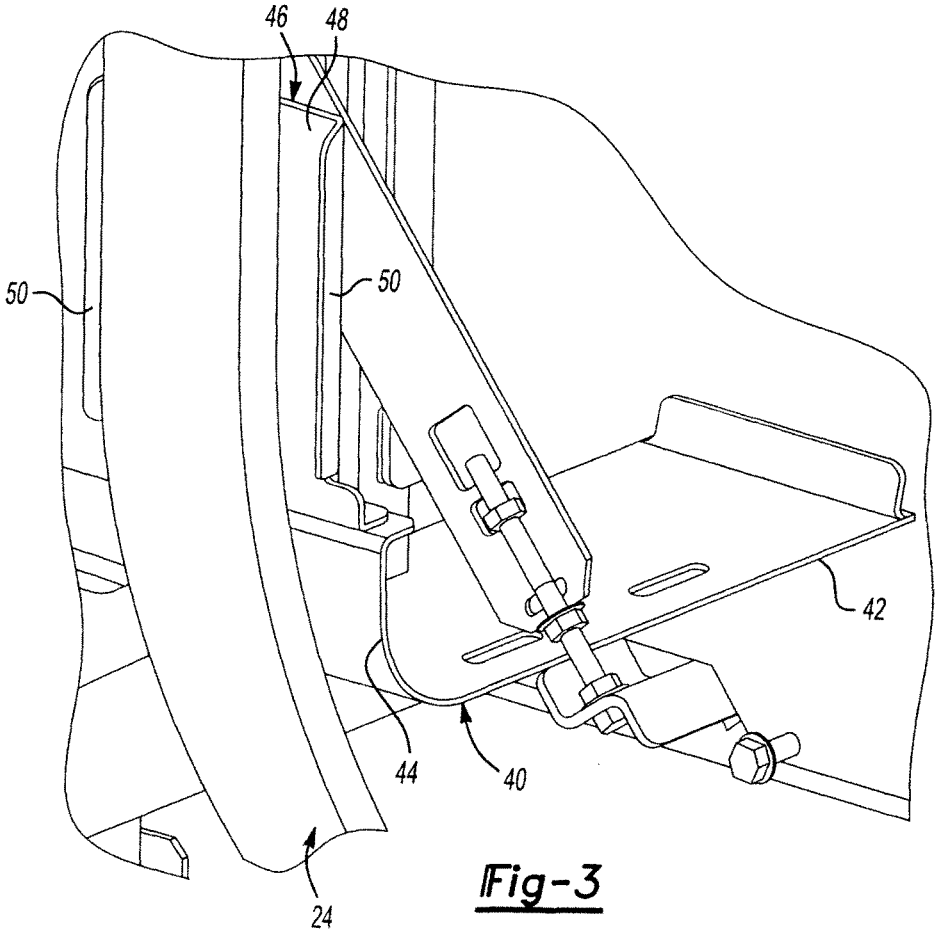
FIG. 3 illustrates the device of FIG. 2 in somewhat more detail.

FIGS. 2 and 3 show one possible example of a device that is useful for protecting the travelling cable 24 as the elevator car 22 approaches the bottom of the hoistway where there is not enough pit depth to accommodate the natural bending radius of the portion 34 of the travelling cable 24 that remains beneath the elevator car 22. The device in this example includes a deflector 40 that is secured to the elevator car 22. The deflector 40 maintains a minimum horizontal distance between the traveling cable 24 and the car 22 and causes the portion 34 of the travelling cable 24 to move closer to the bottom of the elevator car 22 when the car is near the bottom of the hoistway. The deflector 40 allows the portion 34 to be at a distance from the bottom of the elevator car that is at least equal to a natural bending radius of the travelling cable 24 when the elevator car 22 is at least a selected height above the bottom of the hoistway. The deflector 40 facilitates the portion 34 moving closer than the natural bending radius to the bottom of the elevator car 22 when the car is below the selected height.

The illustrated deflector 40 includes a first, horizontally oriented portion 42, a rounded section 44 and a second, vertically oriented portion 46. The first portion 42, the rounded section 44 and the second portion 46 together establish a relatively rigid bracket that deflects the portion 34 of the travelling cable 24 when the elevator car 22 is near the bottom of the hoistway. In one example, the deflector 40 comprises metal pieces. In the illustrated example, the first portion 42 and the rounded section 44 are each formed from one metallic piece, while the second portion 46 is formed of a second metallic piece that is secured to the other. A person skilled in the art who has the benefit of this disclosure will realize that alternate deflector configurations are possible as well.

In this example, the rounded section 44 and the second portion 46 contact or engage the travelling cable 24. In this example, the second portion 46 includes a contact surface 48 configured to contact the travelling cable 24. The second portion 46 in this example also includes guide surfaces 50 adjacent the contact surface 48 for guiding the travelling cable 24 into contact with the contact surface 48.

The length of the travelling cable 24 between the ends 28 and 26 is generally selected based upon the length of the hoistway and the depth of the pit. In some examples, the length is selected so that a distance X between the lowermost portion of the travelling cable 24 (i.e., the center of the natural dynamic bending radius) and the pit floor has a predetermined relationship to a distance H between the pit floor and a floor surface of the elevator car 22. In one example, an elevator installer selects the length of the travelling cable 24 to satisfy the equation $X=(H-360)/2$ where X and H are expressed in millimeters.

As the elevator car 22 approaches the bottom of the hoistway, some of the travelling cable 24 will come into contact with the contact surface 48 and the rounded section 44 of the device 40. The position of the second portion 46 relative to the side of the elevator car 22, which is dictated at least in part by a length of the first portion 42, causes deflection of the portion 34 of the travelling cable 24 when the elevator car 22 moves sufficiently downward in the hoistway. At higher positions in the hoistway, the deflector 40 has only minimal effect, if any, on the position of the travelling cable 24 relative to the elevator car 22. When the car 22 is low enough and the portion 34 of the traveling cable 24 is consequently short enough, the deflector 40 causes the portion 34 to be closer to the bottom of the elevator car 22.

Figure 4:
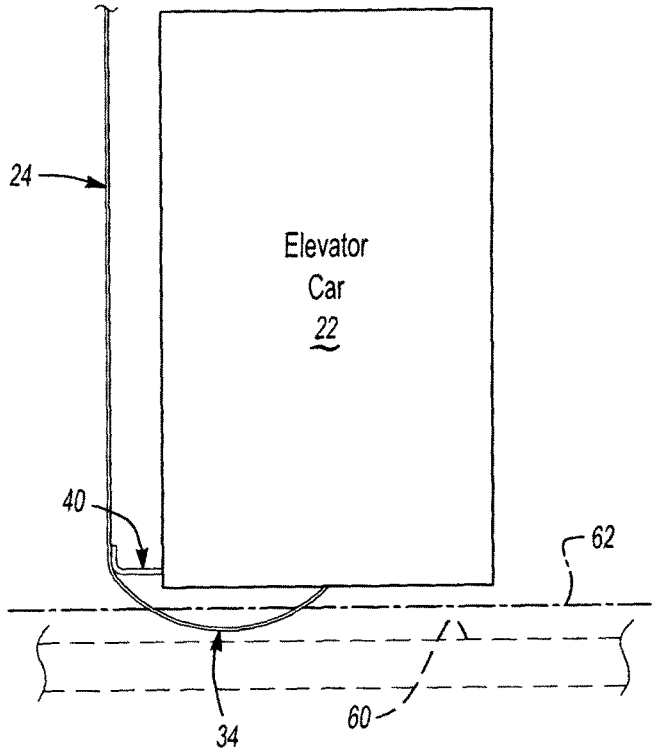
FIG. 4 schematically illustrates the device of FIGS. 2 and 3 in use as an elevator car approaches the bottom of a hoistway.

As can be appreciated from FIG. 4, as the elevator car 22 approaches a floor of the pit shown schematically at 60, the portion 34 of the travelling cable 24 would make contact with the pit floor 60 if it were not for the presence of the device 40. The natural bending radius of the travelling cable 24 would result in contact between the travelling cable 24 and the pit floor 60. The deflector 40 facilitates deflecting at least the portion 34 so that contact with the pit floor 60 can be avoided. The length of the travelling cable 24 is selected so that the deflector 40 causes a change in the bending radius of the portion 34 of the travelling cable 24 as the elevator car 22 approaches a lowest landing position 62 in the hoistway.

Figure 5:
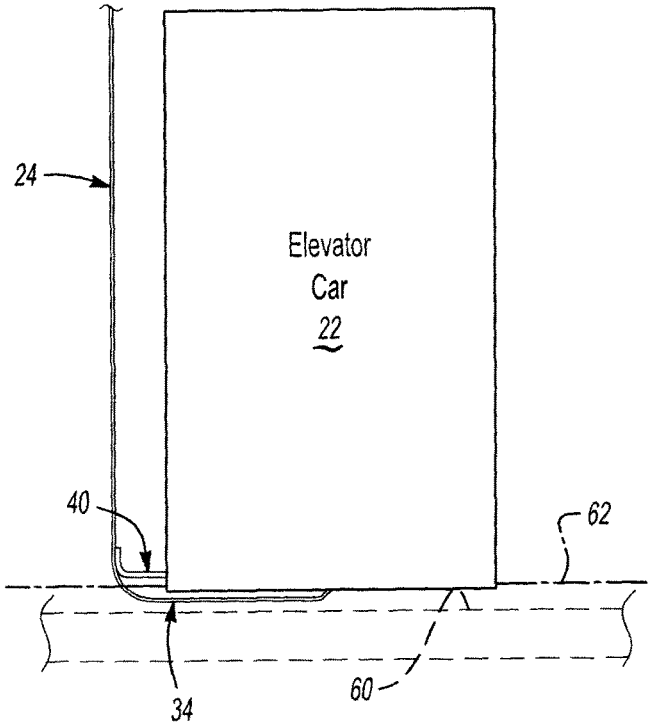
FIG. 5 illustrates the device of FIG. 4 after the elevator car has descended further and closer to the bottom of the hoistway.

FIG. 5 illustrates the arrangement from FIG. 4 after the elevator car has descended further and closer to the pit floor 60. In this example, the elevator car 22 has descended below the lowest landing position 62. The portion 34 of the travelling cable 24 is at least partially flattened out beneath the elevator car 22 as a result of the length of the travelling cable 24, the vertical position of the elevator car 22, and the presence of the deflector 40. The contact surface 48 effectively forces some of the travelling cable 24 to be spaced away from the side of the elevator car 22 and deflects the portion 34 into an orientation that is different than the natural radius of the portion 34. In other words, the deflector 40 deflects at least the portion 34 of the travelling cable 24 to avoid contact between the portion 34 and the pit floor 60. The deflector 40 facilitates the portion 34 moving closer to the bottom of the elevator car 22 when the elevator car is near a bottom of the hoistway compared to when the elevator car is in a higher position within the hoistway. The deflector 40 also avoids contact between the travelling cable 24 and a lower edge of the elevator car 22.

The illustrated example allows for the travelling cable 24 to have the natural dynamic bending radius below the elevator car 22 for much of the travel of the elevator car 22 within the hoistway. This avoids undesirable sway of the travelling cable 24. Even though the natural dynamic bending radius is not maintained when the elevator car 22 approaches the bottom of the hoistway, there is no concern with undesirable sway of the travelling cable 24 under those conditions. It follows that the illustrated example and those that are described below allow for having a reduced pit depth that cannot accommodate the natural dynamic bending radius of a travelling cable while allowing for that natural dynamic bending radius to be used for avoiding undesirable sway of the travelling cable within a hoistway.

Figure 6:
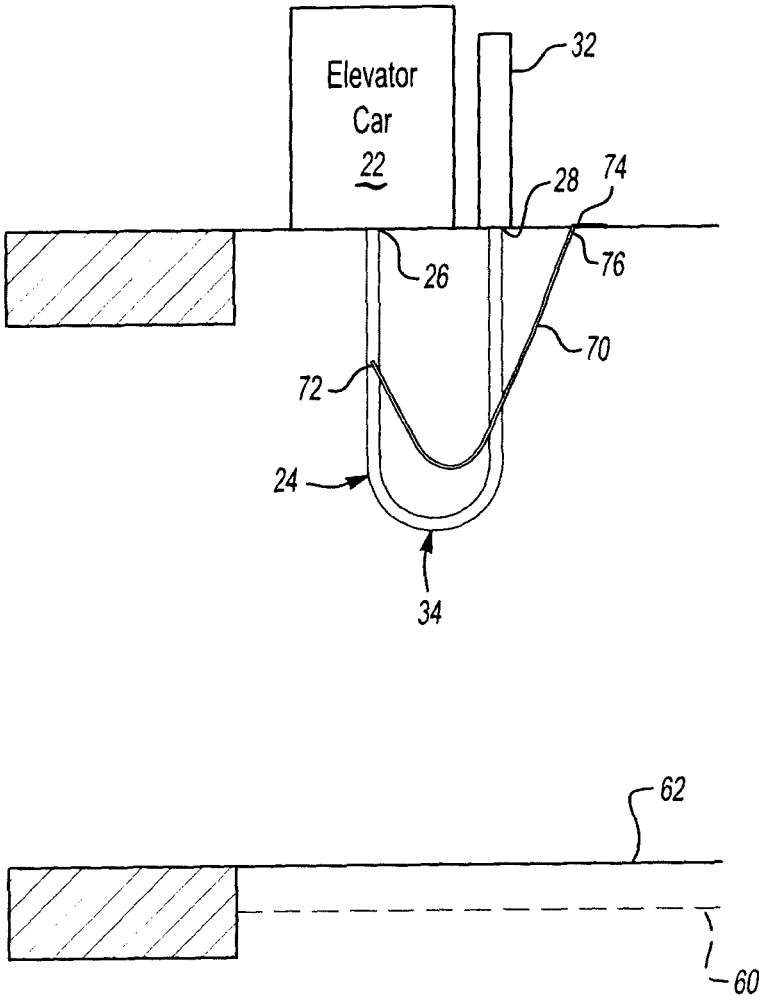
FIG. 6 schematically illustrates another exemplary device for protecting an elevator travelling cable.

FIG. 6 schematically shows another example embodiment of a device for protecting the travelling cable 24. This example includes a deflector 70 comprising a sling having a first end 72 secured to the travelling cable 24 using a bracket that is secured about the cable 24 in a selected position along the length of the cable 24. A second end 74 of the sling 70 is secured in a fixed position relative to the hoistway. In this example, the second end 74 is secured near a fixed surface 76, such as a floor surface. The length of the sling 70 is shorter than the length of the travelling cable 24. The location at which the first end 72 of the sling 70 is secured to the travelling cable 24 is selected based upon the length of the sling and the vertical distance between the second end 74 of the sling and the pit floor 60, for example. Given this description, those skilled in the art will be able to select a location for the end 74 to meet the needs of their particular situation.

Figure 7:
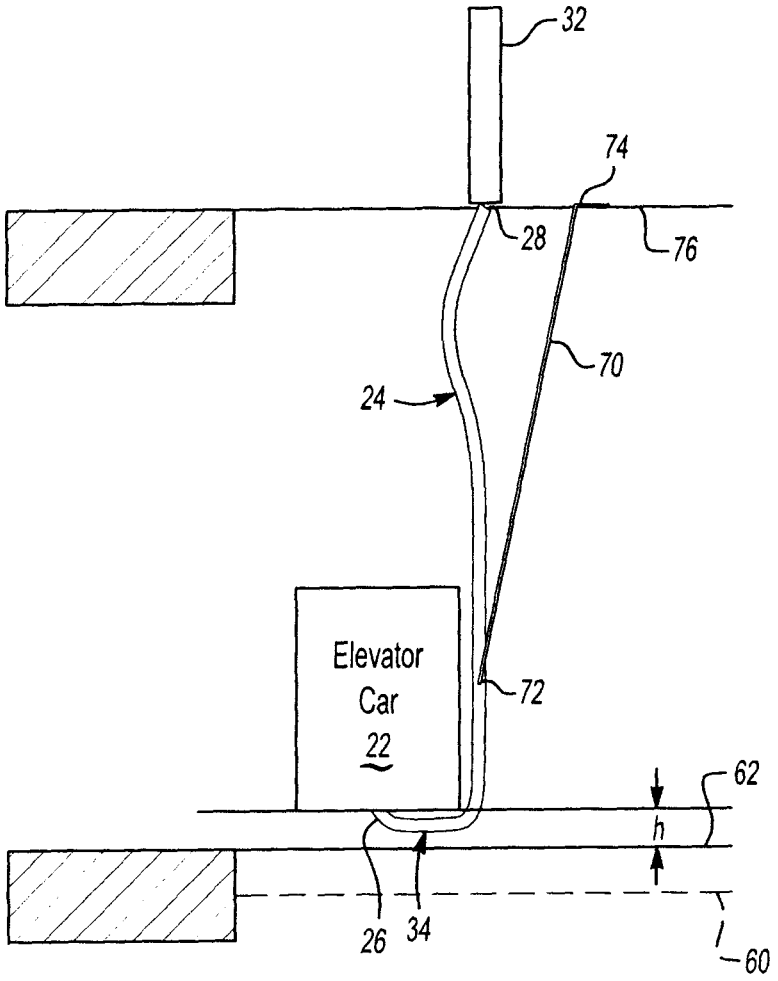
FIG. 7 schematically illustrates the example of FIG. 6 in use as an elevator car approaches a bottom of the hoistway.
Figure 8:
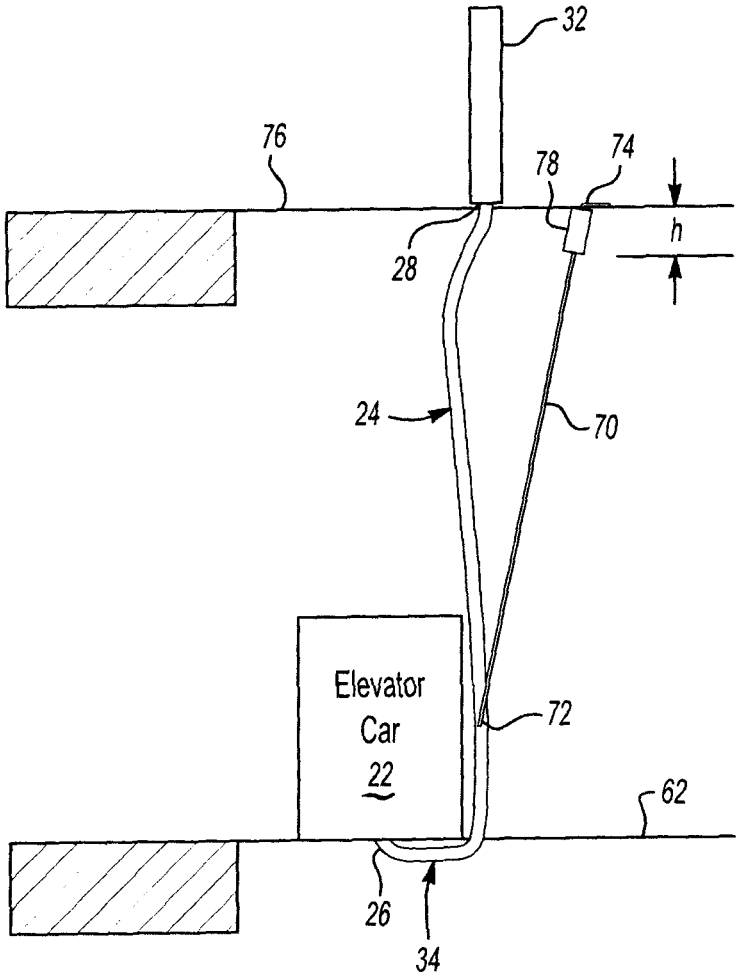
FIG. 8 illustrates the device of FIG. 7 as the elevator car moves further downward and closer to the bottom of the hoistway.

FIG. 6 schematically illustrates an example situation in which the elevator car 22 is within the hoistway above the pit floor 60 at a distance sufficient to accommodate the natural dynamic bending radius of the portion 34 below the elevator car 22. FIG. 7 shows the elevator car 22 in a lower position within the hoistway, which in this example corresponds to the elevator car 22 approaching a lowest landing position 62. As shown in FIG. 7, the sling 70 is pulled tight when the elevator car 22 is a distance h above the lowest landing position 62. The sling 70 facilitates movement of the portion 34 closer to the bottom of the elevator car 22. The sling 70 deflects the portion 34 so that it does not have its natural dynamic bending radius. Bringing the portion 34 closer to the bottom of the elevator car 22 allows the elevator car 22 to approach the pit floor 60 without requiring a relatively deep pit depth to accommodate the natural bending radius of the travelling cable 24. Given the position of the elevator car 22 in this condition, there is no concern regarding sway of the travelling cable even though the natural dynamic bending radius of the travelling cable is not maintained FIG. 8 illustrates a feature of the example sling 70. A resilient member 78 is near the end 74 of the sling 70. The resilient member 78 allows for some stretch and resiliency in the sling 70. Comparing the illustration of FIG. 7 to that of FIG. 8, the elevator car 22 has descended to the lowest landing position 62 in FIG. 8. The distance h is accommodated by stretching of the resilient member 78.

Figure 9:
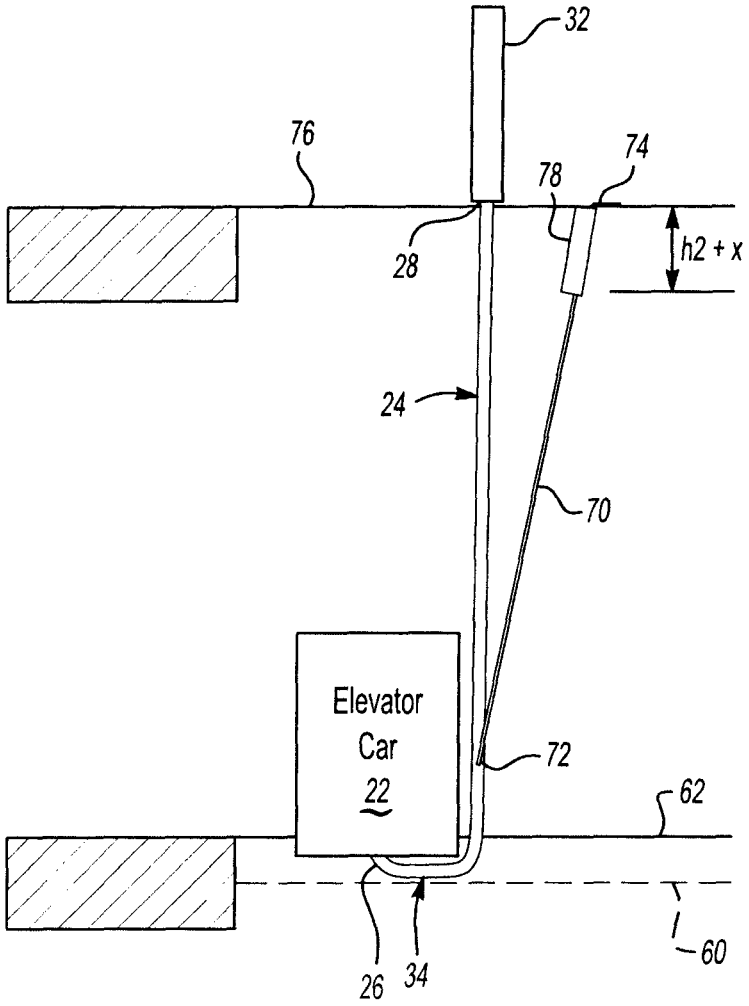
FIG. 9 illustrates the device of FIG. 8 after the elevator car has descended to a lowest position in the hoistway.

In the event that the elevator car 22 descends further and closer to the pit floor 60 as shown in FIG. 9, the resilient member 78 continues to expand to accommodate such further movement of the elevator car 22. The further expansion or extension of the resilient member 78 is represented by the distance h2+x in FIG. 9. As can be appreciated in FIG. 8, there still is some slack in the travelling cable 24 while in FIG. 9, there is less slack or none in the travelling cable 24. The portion 34 of the travelling cable 24 may be pulled closer to the bottom of the elevator car 22 when the car is in the position shown in FIG. 9, compared to when the car is in the position shown in FIG. 8.

In one example, the resilient member 78 is selected to have a spring constant that avoids any break or damage in the travelling cable 24 and the sling 70. In one example, the resilient member 78 comprises a spring. Those skilled in the art that have the benefit of this description will be able to select appropriate materials for the sling 70 and the resilient member 78 to meet the needs of their particular situation.

In one example, the distance traveled by the elevator car between an uppermost landing and a lowermost landing of the hoistway is 45 meters. The end 72 of the deflector 70 is secured to the travelling cable 24 about 942 millimeters from the bottom of the elevator car 22. The length of the travelling cable 24 in this example is about 44.5 meters. When the bottom of the elevator car 22 is approximately 0.5 meters above the lowest landing position, the deflector 70 is pulled tight as shown in FIG. 7, for example. In this example, the distance h shown in FIG. 7 is approximately 0.5 meters.

In one such example, the travelling cable 24 has a mass per unit length of approximately 0.5 kg/m. The natural dynamic bending radius of the travelling cable 24 is 300 millimeters. In one such example, the resilient member 78 exerts a spring force of about 3.5 kilograms when the bottom of the elevator car 22 is sufficiently high that the deflector 70 is not pulled tight. When the deflector 70 is pulled tight, the resilient member 78 has an associated spring force of about 7.1 kilograms. As the elevator car continues to descend and the resilient member 78 expands, a spring force of 7.4 kilograms corresponds to the resilient member 78 having a 382 millimeter length. Spring forces of 9.5 kilograms at 493 millimeters, 11.5 kilograms at 593 millimeters also exist in that example.

While one particular arrangement has been described, those skilled in the art will realize that different lengths and spring forces will be useful depending on the particular elevator system configuration.

Figure 10:
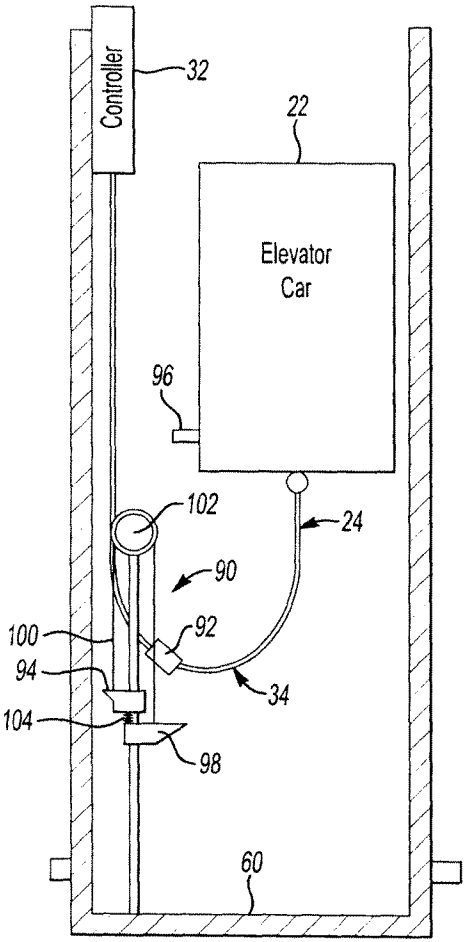
FIG. 10 schematically illustrates another exemplary device for protecting an elevator travelling cable.

FIG. 10 schematically illustrates another example arrangement of a deflector 90 that is useful for protecting the travelling cable 24. This example includes a catch member 92 secured to the travelling cable 24. A lifting member 94 is situated within the hoistway to contact the catch member 92 when the elevator car 22 descends sufficiently within the hoistway.

Figure 11:
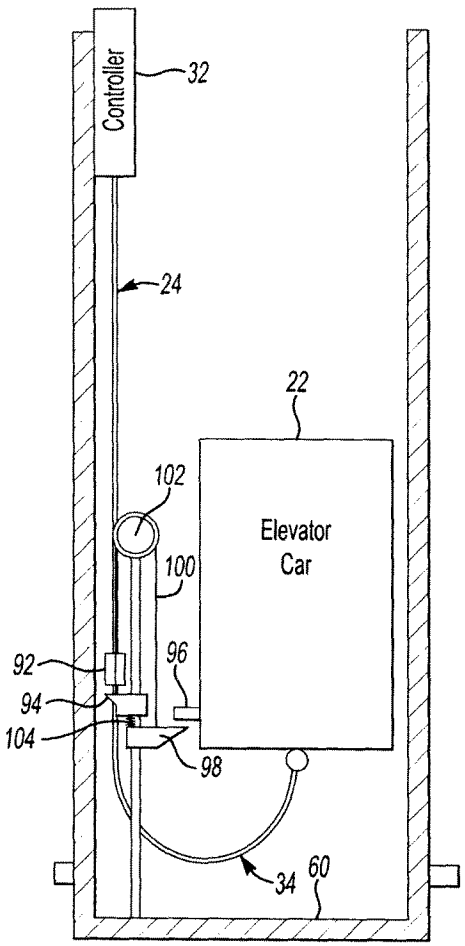
FIG. 11 illustrates the device of FIG. 10 in use as an elevator car approaches a bottom of the hoistway.

FIG. 11 shows the example of FIG. 10 after the elevator car 22 has descended below the position shown in FIG. 10. In FIG. 11, the catch member 92 is just above the lift member 94 and an actuator 96 supported on the elevator car 22 is just above a mover 98. As the elevator car 22 moves downward from the position shown in FIG. 11, the actuator 96 contacts the mover 98 and urges it downward (according to the drawing).

Figure 12:
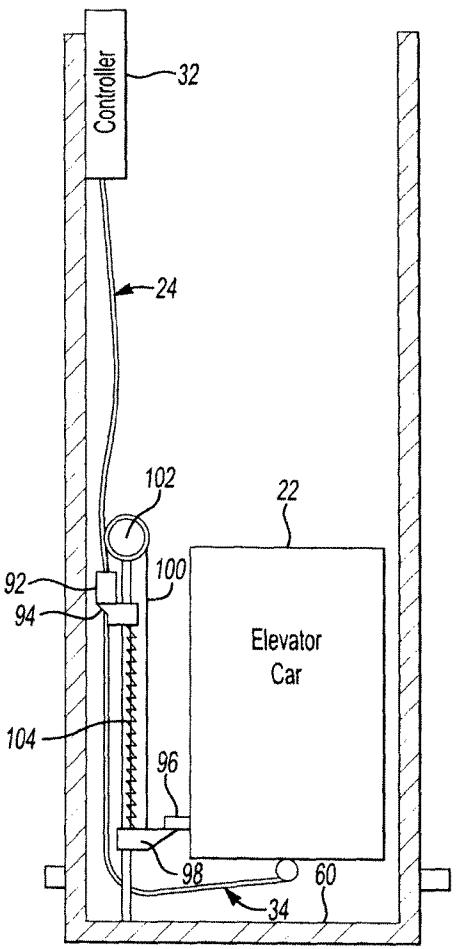
FIG. 12 illustrates the device of FIG. 11 as the elevator car moves further toward and closer to the bottom of the hoistway.

As can be appreciated from FIG. 12, downward movement of the mover 98 resulting from downward movement of the elevator car 22 causes upward movement of the lift member 94 and the catch member 92. In this example, the mover 98 and the lift member 94 are each coupled to a cable 100 that moves over a pulley 102 so that downward movement of the mover 98 results in corresponding upward movement of the lift member 94. A spring 104 urges the mover 98 and the lift member 94 toward each other into the position shown in FIGS. 10 and 11. Descent of the elevator car 22 moves the mover 98 against the bias of the spring 94 and causes the corresponding upward movement of the lift member 94.

As the catch member 92 is secured in a fixed position on the travelling cable 24, upward movement of the catch member 92 caused by the lift member 94 results in changing the radius of the portion 34 of the travelling cable 24 below the elevator car 22. The fixed length of the travelling cable 24 between the catch member 92 and the bottom of the elevator car 22 and the position of the lift member 94 reduces the bending radius of the travelling cable 24 below the elevator car 22. As the elevator car 22 descends further, the portion 34 of the travelling cable 24 moves closer to the bottom of the elevator car 22.

The illustrated arrangement allows for utilizing the natural dynamic bending radius of the travelling cable 24 in many positions within the hoistway while still being able to reach a desired lowermost position of the elevator car 22 even when the depth of the pit cannot accommodate the natural dynamic bending radius of the travelling cable 24.

As the elevator car 22 ascends in the hoistway from the position shown in FIG. 12, the spring 104 returns the mover 98 and the lift member 94 to the respective positions shown in FIG. 11, for example. Whenever the elevator car 22 is above the position at which the actuator 96 contacts the mover 98, the deflector 90 has no influence on the position of the travelling cable 24 relative to the elevator car 22. This allows for the natural dynamic bending radius of the travelling cable 24 to exist, which avoids undesired sway of the travelling cable 24 throughout much of the movement of the elevator car 22.

In each of the disclosed examples, the deflector effectively causes the travelling cable 24 to extend below the elevator car 22 in such a way that a distance between a lowest portion or point of the travelling cable 24 and the bottom of the elevator car 22 is less than the natural dynamic bending radius of the travelling cable 24. In each example, the positions of the components and the length of the travelling cable 24 are selected to accommodate at least a static bending radius of the travelling cable 24. Those skilled in the art appreciate that the static bending radius of the travelling cable is determined by a cable manufacturer as the minimum static bending radius that is required to avoid damage to the cable, which may be caused by excessive bending or folding of the cable.

The illustrated example devices for protecting an elevator travelling cable facilitate moving the portion 34 of the travelling cable 24 closer to the bottom of the elevator car 22 as the elevator car 22 approaches the bottom of the hoistway. Each of those examples allows for utilizing a shallow pit depth that is not capable of accommodating the natural dynamic bending radius of the travelling cable. Each of the illustrated examples protects the travelling cable without requiring increasing the width of the hoistway. Avoiding any increases in the width of the hoistway satisfies the goal of reducing the amount of space occupied by the elevator system. The disclosed examples also avoid undesirable sway of a travelling cable. The illustrated examples provide an economical and reliable solution to protecting an elevator travelling cable even when there is minimal pit depth available within a hoistway.

While several examples are disclosed as distinct embodiments, it is possible to combine one or more features of any of the disclosed embodiments with another of them.

The preceding description is exemplary rather than limiting in nature. Variations and modifications to the disclosed examples may become apparent to those skilled in the art that do not necessarily depart from the essence of this invention. The scope of legal protection given to this invention can only be determined by studying the following claims.

We claim:

1. A device for protecting an elevator travelling cable connected to an elevator car, comprising:

a sling that is secured to the travelling cable, the sling allowing the travelling cable to extend below an associated elevator car a first distance from a bottom of the elevator car when the elevator car is at least a selected height above a bottom of a hoistway, the first distance being at least equal to a natural dynamic bending radius of the travelling cable, the sling facilitating the travelling cable extending below the bottom of the elevator car a second distance less than the natural dynamic bending radius when the elevator car is below the selected height, wherein the sling has a first end secured to a fixed location on the travelling cable and a second end configured to be secured to a stationary surface of the hoistway.

2. The device of claim 1, wherein the sling comprises a resilient member associated with at least one of the first end or the second end of the sling for resiliently supporting the sling relative to the stationary surface.

3. The device of claim 2, wherein the resilient member comprises a spring.

4. The device of claim 1, wherein the second end of the sling remains in one vertical position in the hoistway.

5. An elevator system, comprising:

an elevator car supported for movement within a hoistway;

a travelling cable having a first end connected to the elevator car and a second end supported in a fixed position relative to the hoistway;

a sling that is secured to the travelling cable, the sling allowing the travelling cable to extend below the elevator car a first distance from a bottom of the elevator car when the elevator car is at least a selected height above a bottom of the hoistway, the first distance being at least equal to a natural dynamic bending radius of the travelling cable, the sling facilitating the travelling cable extending below the bottom of the elevator car a second distance less than the natural dynamic bending radius when the elevator car is near a bottom of the hoistway, wherein the sling has a first end secured to a fixed location on the travelling cable and a second end secured to a stationary surface of the hoistway, the sling having a length that is shorter than a length of the travelling cable.

6. The elevator system of claim 5, wherein the sling comprises a resilient member associated with the second end of the sling for resiliently supporting the sling relative to the stationary surface.

7. The elevator system of claim 6, wherein the resilient member comprises a spring.

8. The elevator system of claim 5, wherein the second end of the sling remains at one vertical position in the hoistway.

* * * * *